US006719536B2

(12) United States Patent
Schmalz et al.

(10) Patent No.: US 6,719,536 B2
(45) Date of Patent: Apr. 13, 2004

(54) VACUUM GENERATOR WITH POWER FAILURE OPERATION MODE

(75) Inventors: Kurt Schmalz, Dornstetten (DE); Thomas Eisele, Fluorn-Winzeln (DE)

(73) Assignee: J. Schmalz GmbH, Glatten (DE)

( * ) Notice: Subject to any disclaimer, the term of this patent is extended or adjusted under 35 U.S.C. 154(b) by 0 days.

(21) Appl. No.: 10/123,409

(22) Filed: Apr. 17, 2002

(65) Prior Publication Data

US 2002/0155005 A1 Oct. 24, 2002

(30) Foreign Application Priority Data

Apr. 18, 2001 (DE) ..... 101 18 885

(51) Int. Cl.[7] ..... F04B 5/48; F04B 5/46
(52) U.S. Cl. ..... 417/187; 417/180; 417/189
(58) Field of Search ..... 417/187, 180, 417/189, 191; 269/21

(56) References Cited

U.S. PATENT DOCUMENTS

| | | | | | |
|---|---|---|---|---|---|
| 4,655,692 | A | * | 4/1987 | Ise | 417/187 |
| 4,865,521 | A | * | 9/1989 | Ise et al. | 417/187 |
| 5,277,468 | A | * | 1/1994 | Blatt et al. | 294/64.2 |
| 5,887,623 | A | * | 3/1999 | Nagai et al. | 137/884 |

FOREIGN PATENT DOCUMENTS

| | | |
|---|---|---|
| DE | 35 40 937 | 5/1987 |
| DE | 35 22 111 | 9/1993 |

* cited by examiner

*Primary Examiner*—Justine R. Yu
*Assistant Examiner*—Timothy P. Solak
(74) *Attorney, Agent, or Firm*—Paul Vincent

(57) ABSTRACT

Vacuum generator comprising an ejector nozzle which is connected to a compressed-air supply via a compressed-air line, and with a first valve for opening and closing the compressed-air line, wherein a second electrical valve is connected to the suction line of the ejector which is open in the currentless state to connect a pneumatic vacuum switch, circuited in parallel with the first valve, to the suction line.

11 Claims, 7 Drawing Sheets

VACUUM GENERATOR WITH POWER FAILURE OPERATION MODE

This application claims Paris Convention priority of DE 101 18 885.4 filed Apr. 18, 2001.

BACKGROUND OF THE INVENTION

The invention concerns a vacuum generator comprising an ejector nozzle which is connected to a compressed-air supply via a compressed-air line, and a first valve for opening and closing the compressed-air line.

Different kinds of vacuum generators are used to produce an underpressure. In the field of automation, vacuum generators are used which generate an underpressure using the Venturi principle. These vacuum generators are called ejectors and require compressed air for building up the underpressure. These vacuum generators are advantageous in that they are small and can rapidly produce an underpressure. Moreover, they usually do not have any moving parts.

For many applications, these ejectors are also provided as compact ejectors which have additional valves for switching the underpressure on or off in a simple fashion. These ejectors can also be provided with further elements, e.g. with vacuum sensors or vacuum switches to measure the underpressure level directly at the ejector nozzle and to subsequently pass on corresponding signals for controlling the valves in dependence on the measured values.

In this fashion, when a certain underpressure has been obtained, the control signals of the vacuum switch act directly on the valves and automatically control the valves in accordance with the desired values. The valves are e.g. switched off when a certain underpressure has been reached, and are switched on again when this underpressure falls below a preset value. Such a device is referred to as a regulated ejector. These ejectors have the substantial advantage that they consume compressed air only when an underpressure must actually be generated. The vacuum switches are usually electrical switches which, in turn, pass electrical signals.

These ejectors have the serious disadvantage that switching or control is no longer possible in case of power failure.

Prior art proposes construction of the electromagnetic valves of the ejector such that, in case of power failure, the compressed air is always applied at the ejector nozzle and a vacuum is always generated. This advantageously prevents the dropping of a vacuum-held load. However, energy is permanently consumed even when no underpressure is required.

To eliminate this disadvantage, ejectors have been developed with purely pneumatic control by constructing the vacuum switch as a pneumatic switch and replacing the electromagnetic valves with pneumatically controlled valves. This increases the control effort within the ejector and the pneumatic signals cannot be passed on to an electric control means (e.g. an SPS) without conversion. The pneumatic structural parts also have a shorter service life than electrically controlled structural parts.

In a further development, electrical and also pneumatic vacuum switches can be used. During normal operation, the electrical switch assumes the control and regulation function. The pneumatic vacuum switch is important only when the electrical switch is ineffective in case of power failure. Since the pneumatic vacuum switches are used in addition to the electrical vacuum switches, a switching cycle of the pneumatic switch is triggered simultaneously with each switching cycle of the electrical switch. The service life of such a system is therefore reduced to the service life of a purely pneumatic system. However, the service life of pneumatic vacuum switches is considerably less than that of electrical switches, since their construction includes a plurality of moving mechanical parts and diaphragms. Therefore, such vacuum generators are not susceptible to power failure but have a shortened service life.

For this reason it is the underlying purpose of the invention to provide a vacuum generator with high operational reliability as well as a long service life.

SUMMARY OF THE INVENTION

This object is achieved in accordance with the invention with a vacuum generator of the above-mentioned type by connecting a second electrical valve to the suction line of the ejector, which is open in the currentless state and which connects a pneumatic vacuum switch, which is connected in parallel to the first valve, to the suction line.

The inventive vacuum generator has a second electrical valve which is permanently electrically controlled to assume its closed position. In this closed position, the second electrical valve interrupts a connection between the suction line and the pneumatic vacuum switch to block switching thereof in response to the pressure in the suction line. The pneumatic vacuum switch assumes its rest position during driving of the second electrical valve.

In case of power failure, the second electrical valve can no longer be controlled and it assumes its rest position in which it is open. In this position, the second electrical valve connects the suction line to the pneumatic vacuum switch which is thereby loaded by the pressure in the suction line. Since the pneumatic vacuum switch is connected in parallel with the first valve, it takes on the function of the first valve which had assumed its closed rest position due to power failure.

The inventive vacuum generator can be controlled during normal operation via the electrical components. In case of power failure, the electrical components are ineffective and assume their rest position. The control function is then taken over by the pneumatic vacuum switch which is connected to the suction line.

The inventive vacuum generator has the substantial advantage that it retains its full function in case of power failure thereby correspondingly controlling the ejector nozzle. The service life of the vacuum generator is not impaired thereby since the pneumatic vacuum switch is not used during normal operation and assumes its function only in case of power failure.

In a further development, the operating point of the pneumatic vacuum switch can be set. The desired value of the underpressure is set through this operating point at which the vacuum switch changes from the closed into the open position or from the open into the closed position. Preferably, there are two operating points, an operating point for the maximum underpressure and an operating point for the minimum underpressure.

In a further development, the first valve and the second valve are connected via a piping connection to inhibiting members provided on the ejector nozzle. Both the first valve and the pneumatic vacuum switch can thereby control the ejector nozzle via this a piping connection.

Preferably, an electrical vacuum switch is provided for detecting the prevailing underpressure. This electrical vacuum switch determines the operating points of the first valve by controlling this valve at the desired maximum and at the desired minimum underpressure. This electrical vacuum switch cannot function during power failure and is replaced by the pneumatic vacuum switch.

Further advantages, features and details of the invention can be extracted from the following description which shows different switching situations of the inventive vacuum generator with reference to the drawing. The features shown in the drawing and mentioned in the claims and in the description may be essential to the invention either individually or collectively in any arbitrary combination.

DESCRIPTION OF THE PREFERRED EMBODIMENT

Figure 1:
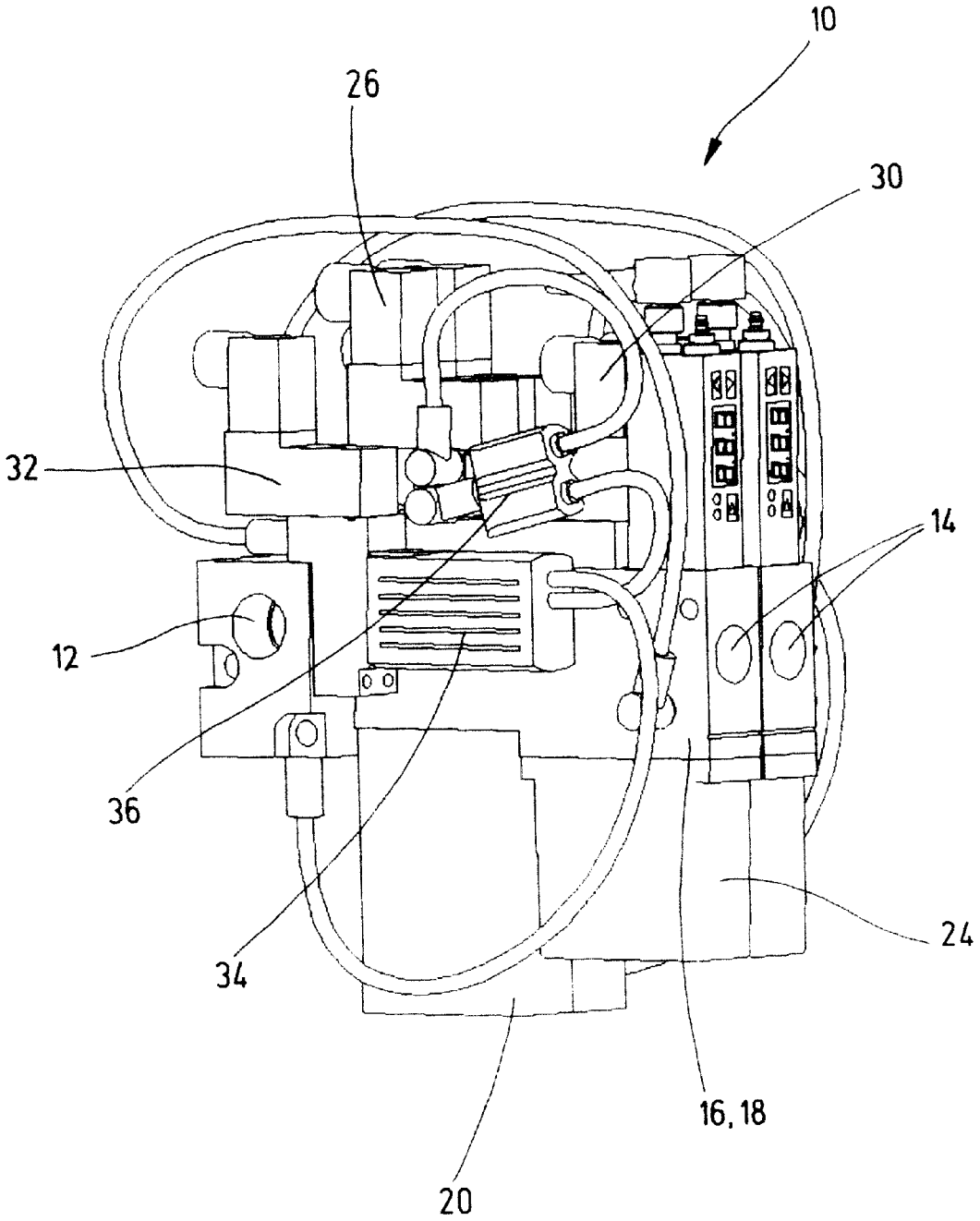
FIG. 1 shows a perspective representation of the inventive vacuum generator.

FIG. 1 shows an embodiment of the inventive vacuum generator, referred to in its entirety with 10 which is formed as a double block. 12 designates a compressed-air supply for connection to an existing compressed-air network.

The two suction connections 14 form the suction gripping connection to the ejector 16 with ejector nozzle 18. One or more suction grippers 22 (FIG. 2) can be connected to the suction connection 14. The compressed air is exhausted via a sound absorber 20. The air suctioned via the suction gripper 22 passes through a filter 24 before entry into the ejector nozzle 18.

Figure 2:
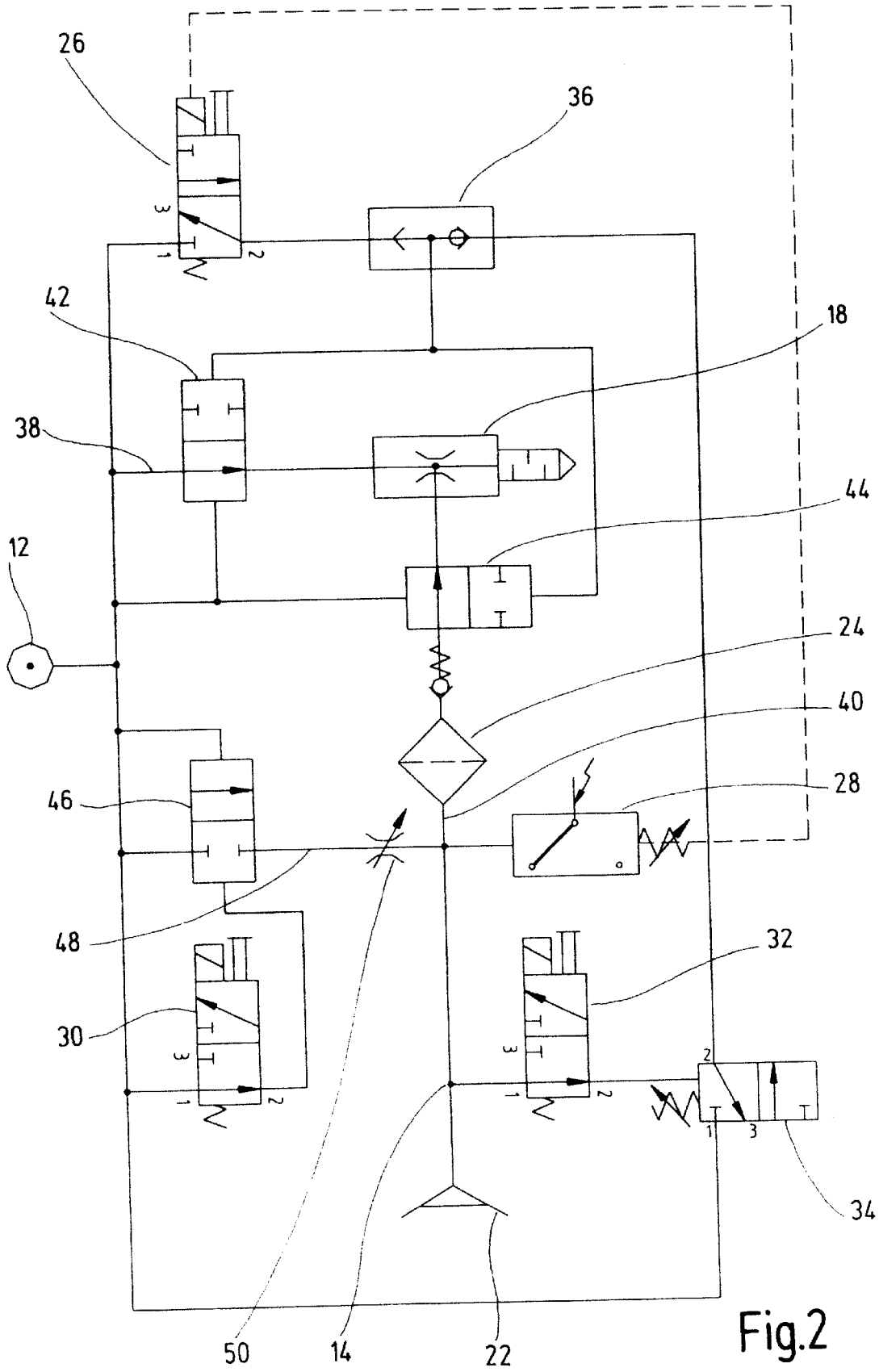
FIG. 2 shows a wiring diagram for the inventive vacuum generator in the basic position.

To control the ejector nozzle 18, the vacuum generator 10 comprises an electrically operated first valve 26. This first valve 26 controls the compressed-air supply to the ejector nozzle 18 and the connection of the underpressure line. The vacuum generator 10 also has an electrical vacuum switch 28 via which the first valve 26 is controlled in dependence on the underpressure in the suction line 40 (FIG. 2). Moreover, an electrically controlled valve 30 is provided for connecting the suction line 40 to the compressed-air line 38 (FIG. 2) for discharge of the load.

Finally, the vacuum generator 10 comprises a second electrical valve 32 which assumes its closed position during normal operation of the vacuum generator 10. This second valve 32 connects a pneumatic vacuum switch 34 to the suction line 40 of the suction gripper 22. The latter is circuited In parallel with the first valve 26 and is connected to the ejector nozzle 18 via 36 a piping connection 36.

The individual switching positions of the structural elements are shown in the following figures. FIG. 2 shows the basic position of the vacuum generator 10. In this basic position, the first valve 26, the electrical valve 30, the second valve 32 and the pneumatic vacuum switch 34 are in their rest positions with the first valve 26 and the pneumatic vacuum switch 34 assuming closed positions and the valves 30 and 32 assuming opened positions. Opened inhibiting members 42 and 44 are located in the compressed-air line 38 and the suction line 40 of the ejector nozzle 18. The electrical valve 30 controls a third inhibiting member 46 which connects the suction line 40 to the compressed-air supply 12. This third inhibiting member 46 is in the closed position. An adjustable throttle 50 is located in this connection line 48 for setting the compressed-air amount to be discharged.

Figure 3:
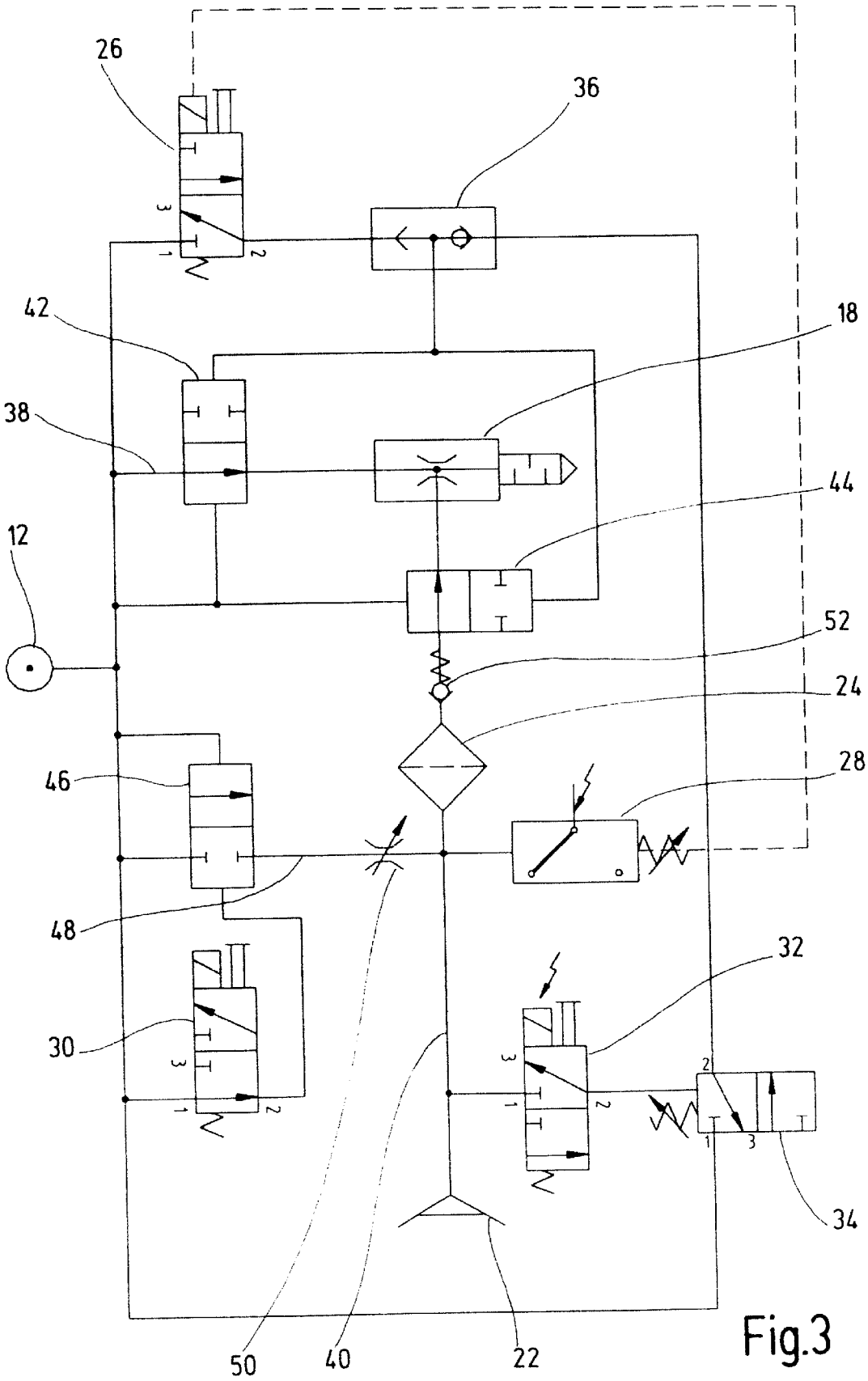
FIG. 3 shows a wiring diagram for the inventive vacuum generator during normal suctioning operation.

FIG. 3 shows the wiring diagram of FIG. 2 with switched-on vacuum generator 10 during suction. This switching position is different in that a voltage is applied to the second valve 32 which changes to the operating position. The connection between the suction line 40 and the pneumatic vacuum switch 34 is thereby interrupted. In this fashion, the pneumatic vacuum switch 34 is not loaded with the underpressure prevailing in the suction line 40. The pneumatic vacuum switch 34 still assumes its rest position.

Figure 4:
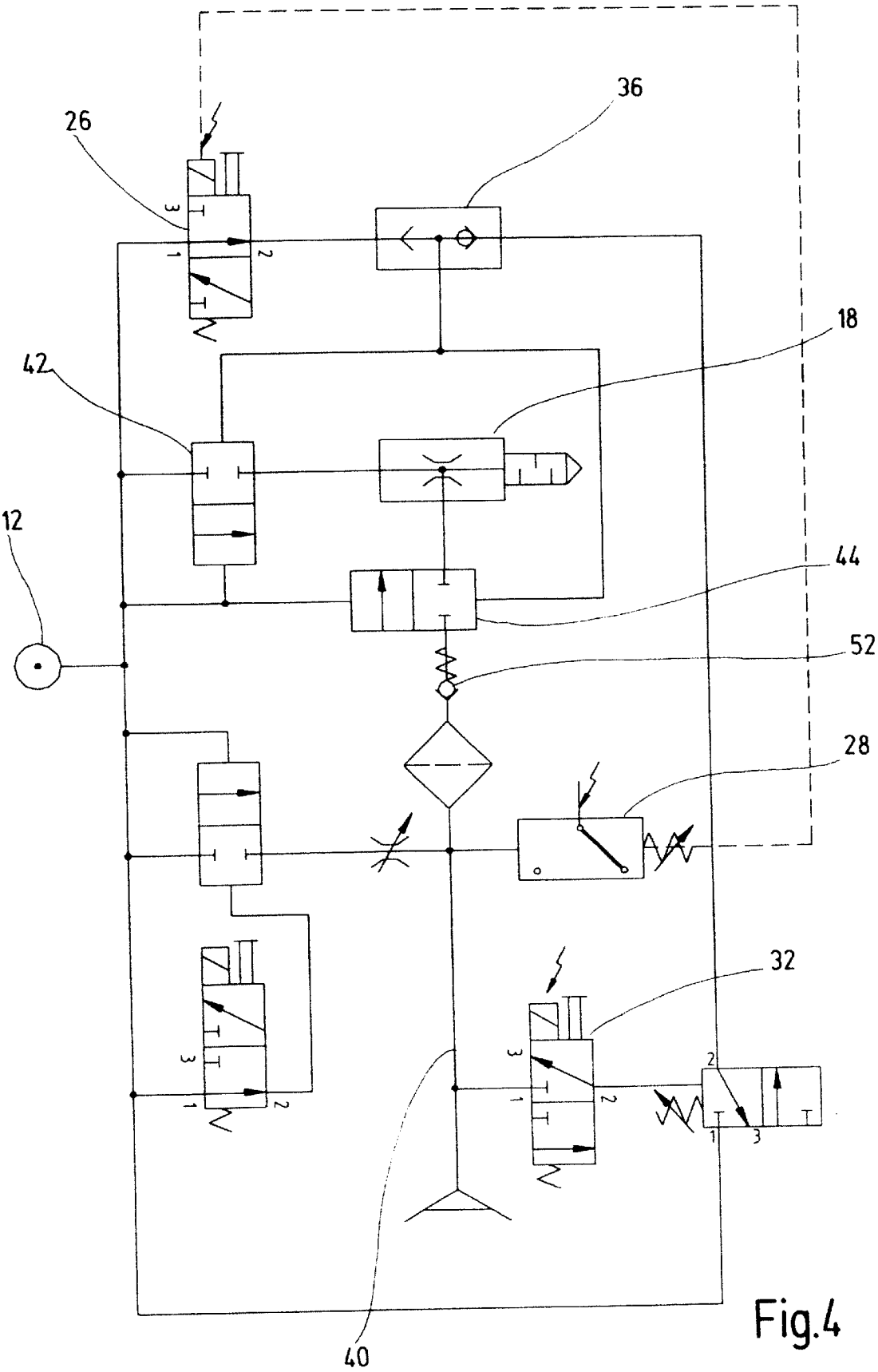
FIG. 4 shows a wiring diagram for the inventive vacuum generator during normal operation with switched-off suctional function.

The electrical vacuum switch 28 detects when the desired underpressure is established in the suction line 40, and sends a signal to the first valve 26 and switches same into its open position. This switching over of the first valve 26 closes the inhibiting member 42 and closes the inhibiting member 44 such that the ejector nozzle 18 is decoupled from the compressed-air supply 12 and is no longer connected to the suction line 40. The underpressure in the suction line 40 is maintained by a check valve 52 (FIG. 4).

Figure 5:
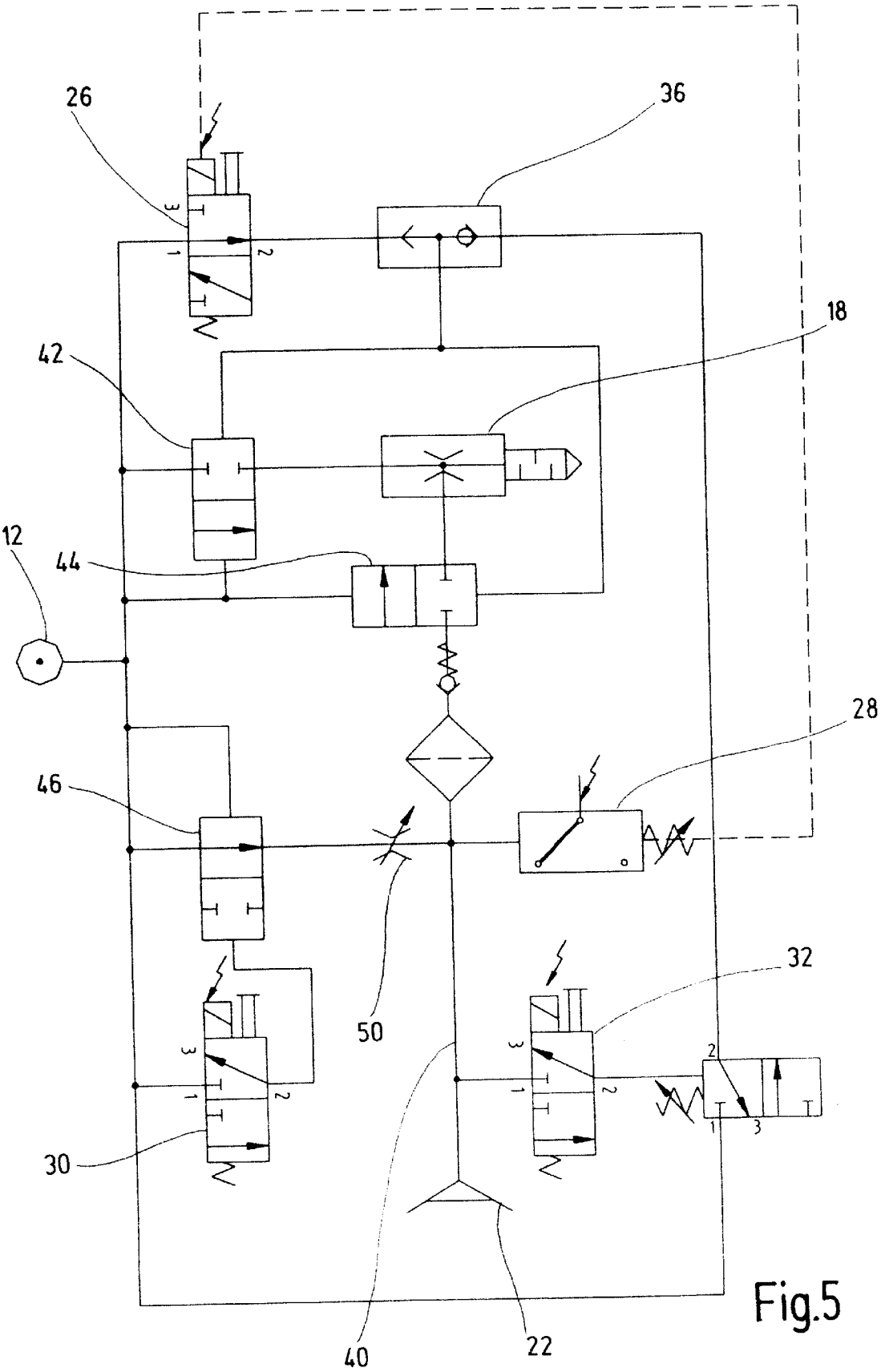
FIG. 5 shows a wiring diagram for the inventive vacuum generator in normal operation during discharge.

The wiring diagram of FIG. 5 shows the state of the vacuum generator 10 during discharge of the load. The first valve 26 and the electrical valve 30 are electrically actuated to change from their rest positions into their operational positions. In this connection, the first valve 26 assumes its open position and the electrical valve 30 assumes its closed position. This closes the two inhibiting members 42 and 44 and the inhibiting member 46 is opened. Opening of the inhibiting member 46 connects the compressed-air supply 12 to the suction line via the throttle 50 and air is blown into the suction line 40 such that a workpiece suctioned by the suction gripper 22 is rapidly ejected.

Figure 6:
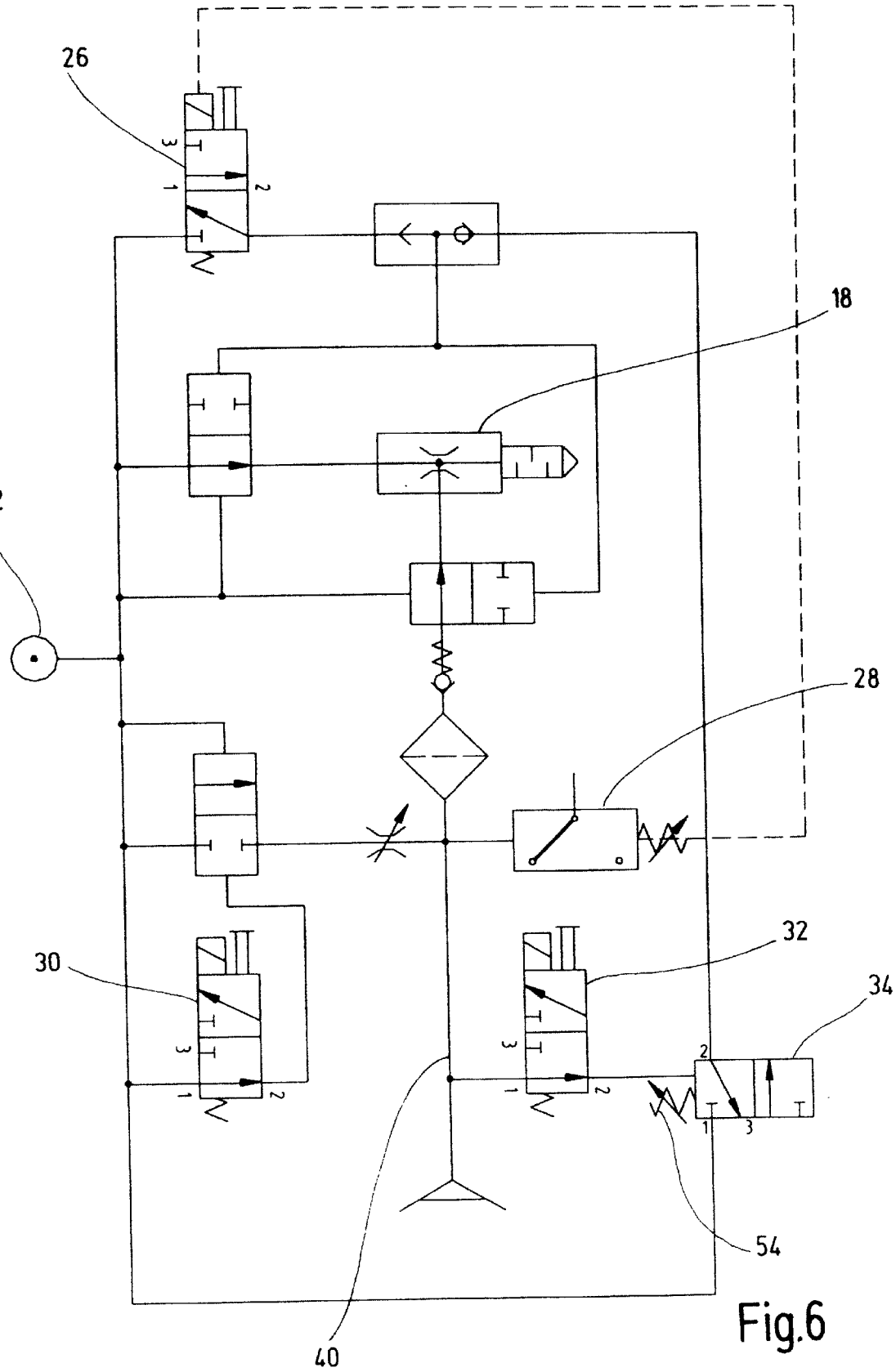
FIG. 6 shows a wiring diagram for the inventive vacuum generator in case of power failure with activated suctioning.

During power failure (shown in FIG. 6), all electrical structural components, e.g. the first valve 26, the electrical vacuum switch 28, the electrical valve and the second valve 32 are currentless and assume their rest position. The first valve 26 is thereby closed and the electrical valve 30 and the second valve 32 assume their open position. The ejector nozzle 18 is loaded with compressed air and produces an underpressure in the suction line 40. This underpressure is passed on to the pneumatic vacuum switch 34 via the second valve 32.

Figure 7:
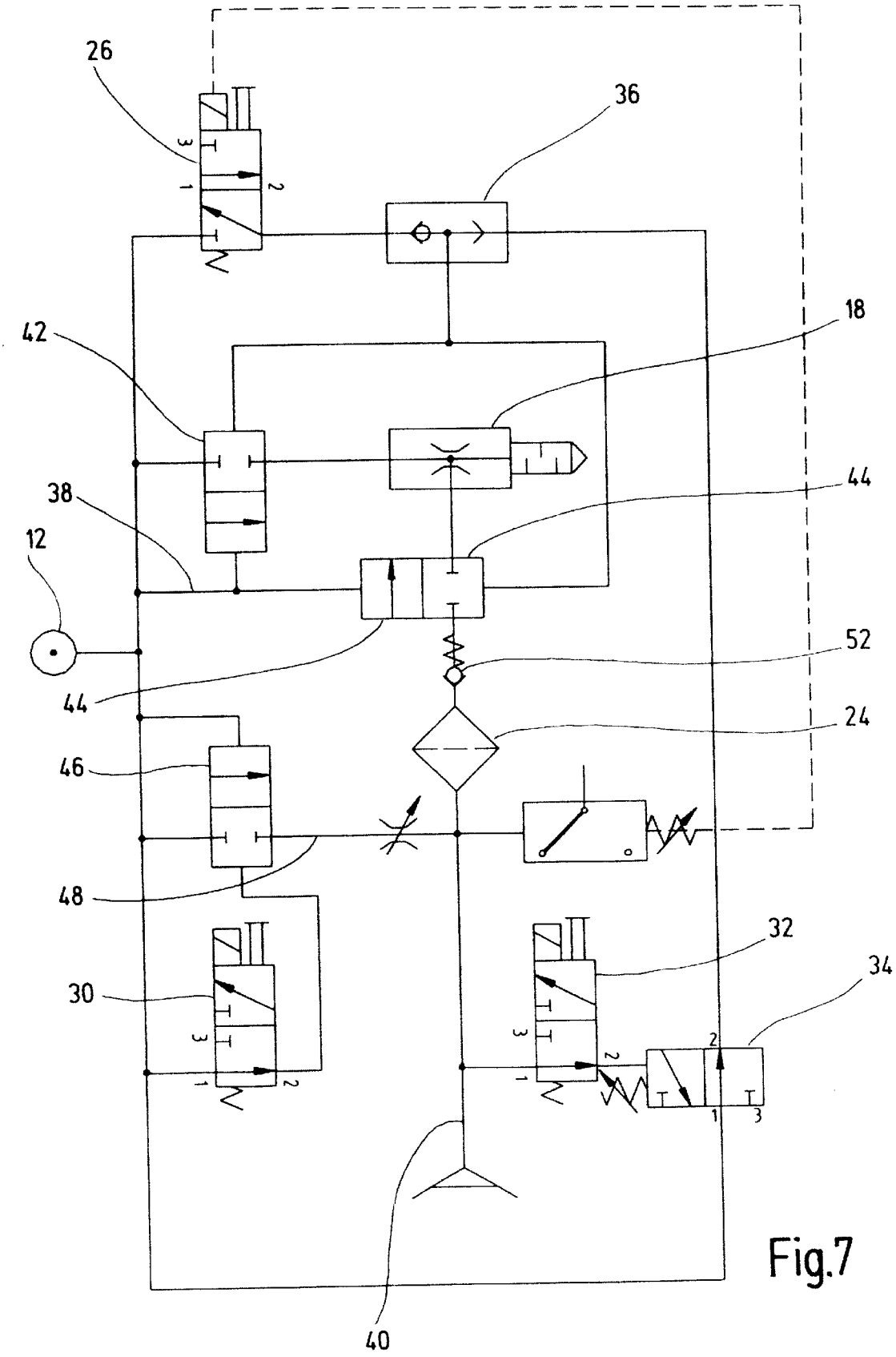
FIG. 7 shows a wiring diagram for the inventive vacuum generator during power failure with switched-off suctioning function.

This pneumatic vacuum switch 34 is maintained in its rest position by an adjustable spring 54. When the underpressure in the suction line 40 reaches a desired value, the pneumatic vacuum switch 34 is switched over from the closed position (FIG. 6) Into the open position (FIG. 7). This operating point can be changed via the adjustable spring 54 and be adjusted to the desired value. In this position (FIG. 7) of the pneumatic vacuum switch 34, the piping connection 36 is connected to the compressed-air supply 12 via the pneumatic vacuum switch 34 which now assumes its open position. The two inhibiting members 42 and 44 are thereby closed such that no compressed air is applied at the ejector nozzle 18 and the suction line 40 is no longer connected to the ejector nozzle 18. The underpressure in the suction line 40 is maintained via the check valve 52.

FIGS. 2 through 7 show clearly that the pneumatic vacuum switch 34 is actuated only when the second valve 32 is currentless which is usually the case only during power failure. In this emergency situation, the vacuum generator 10 can still be operated without any problem using the pneumatic vacuum switch 34 without unnecessary consumption of compressed air.

We claim:

1. A vacuum generator driven by a compressed-air supply, the generator comprising:

an ejector nozzle;

a compressed-air line connected to an input of said ejector nozzle;

a suction line connected to a vacuum output of said ejector nozzle;

a first valve for opening and closing said compressed-air line input to said ejector nozzle;

a pneumatic vacuum switch circuited in parallel with said first valve; and a second electrical valve connected between said suction line and said pneumatic vacuum switch, said second electrical valve assuming an open position when no electrical power flows through said second electrical valve.

2. The vacuum generator of claim 1, wherein, during normal operation, said second valve is actuated and assumes a closed position.

3. The vacuum generator of claim 1, wherein said second valve is open in a rest position thereof.

4. The vacuum generator of claim 1, wherein said pneumatic vacuum switch is normally closed.

5. The vacuum generator of claim 1, wherein an operating point of said pneumatic vacuum switch can be adjusted.

6. The vacuum generator of claim 1, wherein said first valve and said second valve are connected, via a piping connection, to means for inhibiting compressed air input to said ejector nozzle.

7. The vacuum generator of claim 1, further comprising an electrical vacuum switch for detecting a prevailing underpressure in said suction line.

8. The vacuum generator of claim 7, wherein said first valve is electrically actuated by said vacuum switch.

9. The vacuum generator of claim 1, wherein said pneumatic vacuum switch is connected to said suction line during a power failure.

10. The vacuum generator of claim 7, wherein said electrical vacuum switch and said pneumatic vacuum switch detect said underpressure independently of each other.

11. The vacuum generator of claim 1, wherein said ejector nozzle is regulated by said pneumatic vacuum switch during a power failure.

* * * * *